235-380

11/10/81 XR 4,300,040 SR

United States Patent [19]

Gould et al.

[11] 4,300,040

[45] Nov. 10, 1981

[54] ORDERING TERMINAL

[75] Inventors: Geroge K. Gould, Pound Ridge; Eric Steinberg, Bronx, both of N.Y.

[73] Assignee: Video Corporation of America, New York, N.Y.

[21] Appl. No.: 93,893

[22] Filed: Nov. 13, 1979

[51] Int. Cl.[3] ..... G07F 7/08

[52] U.S. Cl. ..... 235/381; 235/380; 340/825.35

[58] Field of Search ..... 235/379, 381; 340/149 A, 153, 152 R; 221/2; 194/4

[56] References Cited

U.S. PATENT DOCUMENTS

| | | | |
|---|---|---|---|
| 1,791,078 | 2/1931 | Fitch | 194/4 R |
| 1,809,693 | 6/1931 | Hahling | 194/4 F |
| 1,866,716 | 7/1932 | McCormick et al. | 194/4 C |
| 2,887,204 | 5/1959 | Giuliano | 194/4 |
| 3,061,143 | 10/1962 | Simjian | 221/2 |
| 3,134,016 | 5/1964 | Connolly et al. | 340/153 |
| 3,267,436 | 8/1966 | Alpert et al. | 235/92 AC |
| 3,401,830 | 9/1968 | Mathews | 235/419 |
| 3,457,391 | 7/1969 | Yamamoto | 235/419 |
| 3,560,715 | 2/1971 | Akamatsu et al. | 235/423 |
| 3,602,695 | 8/1971 | Boss | 340/149 |
| 3,629,834 | 12/1971 | Randall et al. | 340/149 |
| 3,662,343 | 5/1972 | Goldstein et al. | 235/381 |
| 3,691,527 | 9/1972 | Yamamoto | 340/149 A |
| 3,705,384 | 12/1972 | Wahlberg | 340/149 |
| 3,760,162 | 9/1973 | Holter | 235/381 |
| 3,761,682 | 9/1973 | Barnes et al. | 235/379 |
| 3,778,595 | 12/1973 | Hatanaka et al. | 235/379 |
| 3,845,470 | 10/1974 | Schuller | 340/149 A |
| 3,862,716 | 1/1975 | Black et al. | 235/381 |
| 3,908,894 | 9/1975 | Hatanaka et al. | 235/419 |
| 3,914,579 | 10/1975 | Shigemori et al. | 235/381 |
| 3,914,977 | 3/1976 | Voss | 235/379 |
| 3,943,335 | 3/1976 | Kinker et al. | 235/379 |
| 4,011,433 | 3/1977 | Tateisi et al. | 235/381 |
| 4,120,452 | 10/1978 | Kimura et al. | 235/381 |
| 4,134,537 | 1/1979 | Glaser et al. | 235/379 |
| 4,141,078 | 2/1979 | Bridges, Jr. et al. | 235/380 |

*Primary Examiner*—Harold I. Pitts

*Attorney, Agent, or Firm*—Amster, Rothstein & Engelberg

[57] ABSTRACT

An ordering terminal for videocassette program material including a keyboard, credit card reader, TV monitor and speaker and display board. The user can order videocassette program material from the terminal and can preview proposed selection before ordering. The terminal is in communication with a central processing station which in one embodiment of the invention provides complete processing of the customers order. In another embodiment of the invention, the terminal stores videocassette program material and dispenses the program material directly in response to a customer's order. Internal computer and control logic coordinate the functions of the various elements of the system. Videocassettes are returned either by mailing the videocassettes back to the central processing station or by providing a return slot in the terminal for receiving the videocassette after use.

7 Claims, 7 Drawing Figures

FIG. 1
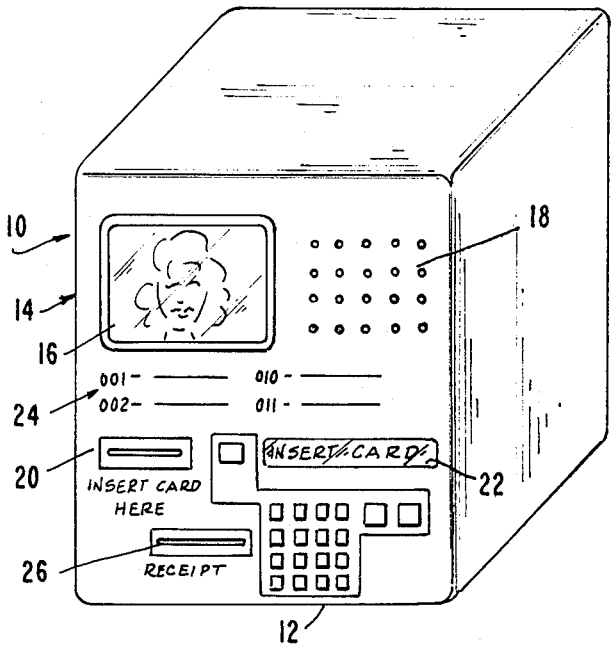
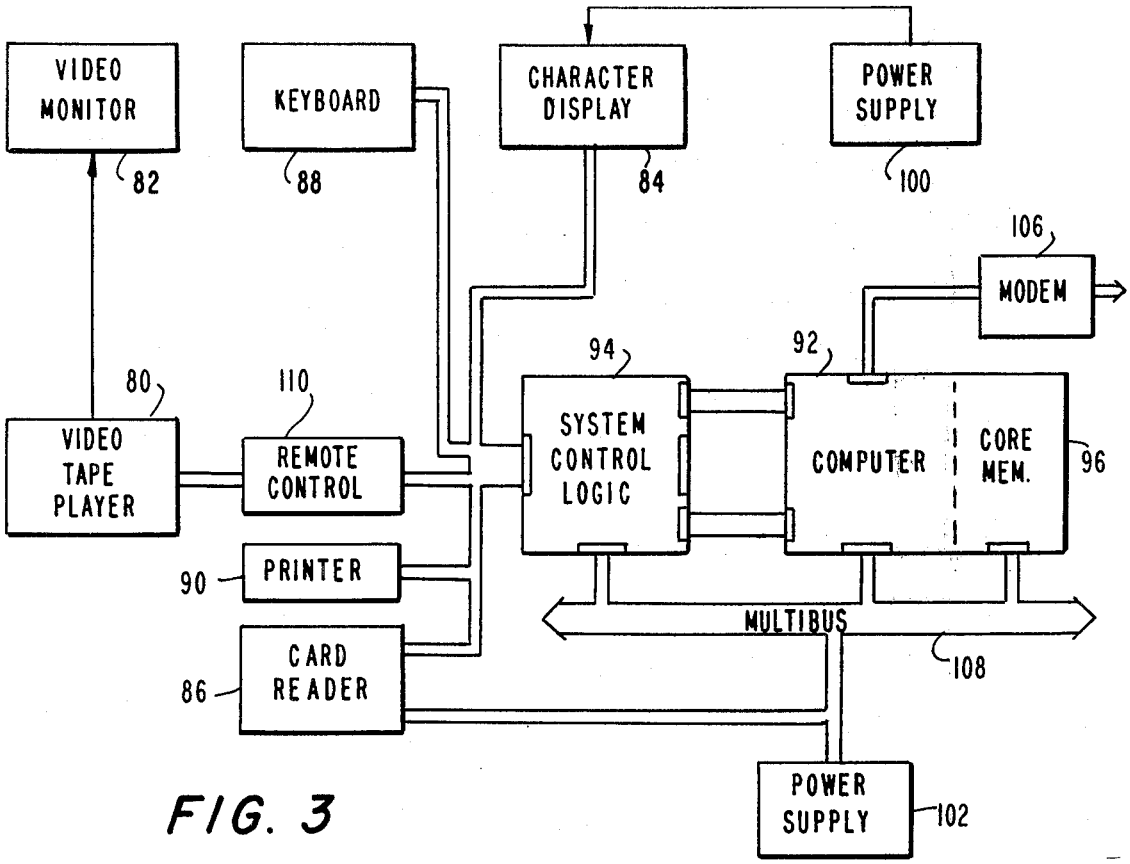
FIG. 3

ORDERING TERMINAL

BACKGROUND OF THE INVENTION

The invention relates to a system for ordering video cassette program material and to a terminal from which such program material can be ordered.

As home videocassette players become more popular, a need has arisen to provide prerecorded video cassettes for home viewing. Such videocassettes can be purchased at selected stores. However, the cost of videocassettes is high and maintaining an inventory of videocassettes by a store can be expensive. It would be more desirable to be able to process orders for videocassettes at a processing location which is connected to a number of ordering terminals from which customers can place orders for selected videocassette program material. Due to the high cost of videocassettes, it would also be desirable to provide a system whereby videocassette program material can be rented for a predetermined period of time rather than purchased outright.

It is an object of this invention to provide such system by which a customer can select videocassette program material at a terminal which is conveniently located for customer use and which is remote from a processing location. The order is processed at the processing location and the videocassette program material provided to the customer.

It is a further object of this invention to provide a terminal from which videocassette program material is vended directly to the customer which is coupled to a processing location from which customer billing is provided.

SUMMARY OF THE INVENTION

In accordance with an embodiment of the invention, a terminal is provided from which a customer can select and order desired videocassette program material. The terminal includes a videocassette program selection station such as a keyboard which permits the customer to enter a coded signal into the terminal corresponding to selected videocassette program material. The keyboard is coupled to a memory which is part of the system control. The memory receives and stores the coded signal from the selection station. The terminal also includes a customer identification station, such as a card reader, also coupled to the memory, which receives customer identification information such as data from a credit card, and transmits this information to a memory location associated with the stored information relating to the selected videocassette program material. The terminal is coupled to a processing location via a communications link whereat customer orders are processed. Periodically, the terminal is interrogated. Ordering and customer information stored in the terminal memory is transferred to the processing location. At the processing location, the information is analyzed, the order filled by sending the selected videocassette program material to the customer and the customer is billed.

Alternatively, the terminal can be provided with stored videocassette program material and can be arranged to supply the selected videocassette program material directly to the customer upon acceptance of an order. With this type terminal system, only customer billing and control of the inventory of videocassettes at the terminal are handled at the processing location.

The terminal also includes a previewing station at which available videocassette program materials can be previewed. Generally, the previews consist of short excerpts from the actual videocassette program material. In one mode of operation, the previews are freely run sequentially so that all the videocassette program material is displayed for transient viewing to attract customers. Provision is also made to permit the customer to preview selected videocassette program material of particular interest to the customer thereby eliminating the necessity for the customer to preview all of the material. In the preferred embodiment of the invention, the preview station includes a video monitor and speaker which are coupled to a videocassette player which plays and replays the videocassette containing the previews. The terminal also includes a display station at which sequential instructions are given to the customer to aid in the operation of the terminal.

A customer wishing to order videocassette program material approaches the terminal. If the terminal is in its Active Mode, the display station will flash a message "Insert Card" and the preview station will be sequentially showing the available videocassette program material. To use the terminal, the customer inserts a credit card or other form of customer identification into the customer identification station. Customer identification is sent to the computer memory. If the customer identification has the correct format, the card is held for the duration of the transaction. The preview station then stops, the message "Dial Program Number" is displayed at the display station and the system enters the Customer Mode. The customer next inputs into the selection station a numerical code representing the selected videocassette program material. After the code has been entered, the message "Preview or Order" appears at the display station. If the customer wishes to preview the selected program material, the "Preview" button is pushed and a preview of the selected videocassette program material is shown at the preview station. If the customer selects "Order", the customer information and selected videocassette program material information are stored in a temporary buffer in the computer memory. The customer may now order additional videocassette program material using the same procedure or enter the End of Order Mode. When the End of Order button is pressed, the ordering information is transferred from the temporary storage to core memory for later transmission to the processing location and the customer identification card is returned to the customer. The terminal then reverts to its Active mode.

BRIEF DESCRIPTION OF THE DRAWINGS

These and other objects and features of the present invention will be apparent to those skilled in the art from the following description when taken in conjunction with the following drawings wherein:

FIG. 1 is an isometric representation of the remote ordering terminal of the invention illustratively shown in the Active Mode and showing the various stations necessary for the proper operation of the terminal to order selected videocassette program material;

FIG. 3 is a block diagramatic representation of the internal electronic control system for the terminal;

DESCRIPTION OF THE PREFERRED EMBODIMENT

Figure 2:
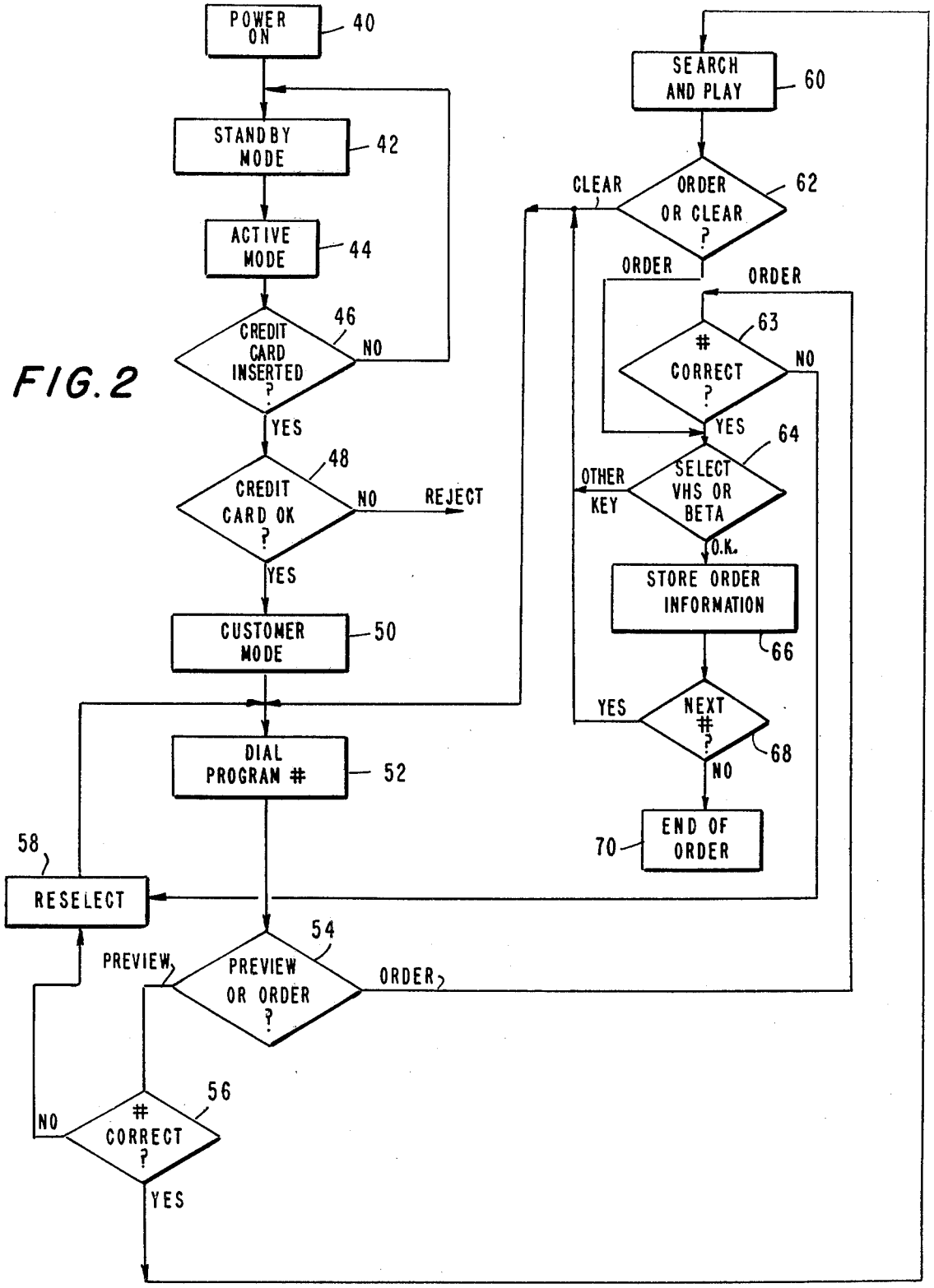
FIG. 2 is a flow diagram representation describing the sequence of operation of the terminal.

In accordance with this invention, remote ordering terminals from which videocassette program material can be ordered from widely separated locations, such as retail stores is provided. The orders are processed at a central location from which the customers' orders are filled and the customers billed. Preferably, the terminals are used in a marketing program, in which the videocassette program material is rented for a fixed time period, rather than purchased, to reduce the cost to the retail customer.

A typical terminal for ordering selected videocassette program material is illustrated in FIG. 1. Terminal 10 includes a keying station 12, typically a keyboard consisting of a plurality of pushbuttons which can be used to enter a code corresponding to the selected video cassette program material, a previewing station 14 including a television monitor 16 and a speaker 18 which is utilized to preview available videocassette program material, a customer information station 20 at which the customer information is obtained and a display station 22, which displays messages for use in aiding in the operation of the terminal. The terminal 10 also includes a listing of the available videocassette program material together with a code uniquely associated with each of the available videocassette program material, indicated generally by reference numeral 24. Provision is also made for issuing a customer a receipt for purchase through receipt slide 26.

To operate the terminal, the customer inserts a customer identification card, such as a credit card, into a customer information station 20. If the card format is accepted, the message "Dial Program Number" appears at display station 22. The customer now inputs information regarding the selected video cassette program material by pushing the appropriate buttons in program select station 12 corresponding to the code number of the selected videocassette program material. The message "Preview Or Order" now appears on the display station 22 and the customer decides whether he wishes to preview the videocassette program material before making the final selection. If he desires to preview the material, he presses the Preview button at the program select station and a preview of the selected videocassette program material is displayed on the television monitor 16 and the sound portion of the preview is heard through speaker 18. If the customer is satisfied and wishes to place the order, he presses the Order button. The message "VHS or Beta" is next displayed on the display station 22 and the customer chooses either the VHS videocassette format or the BETAMAX videocassette format by pressing either the BETA key or the VHS key.

The tape format, the customer information and the code number of the program material are all temporarily stored in a buffer memory in the terminal and the customer is given an opportunity to order additional selections when the message "Clear For Next Number" appears at the display station 22. When the customer completes ordering all selected material he presses the End of Order button. This command results in a transfer of the stored information from buffer memory to core memory where it is stored for later transmission to the processing location. The customer identification card is returned and the message "Remove Card" appears at the display station 22.

Periodically, a remote processing location interrogates all terminals and the information stored in the core memory of the terminal is transmitted to the processing station. At the processing station, the customer information, selected video-cassette program material and tape format is obtained and the proper videocassette program material is sent to the customer.

A more detailed understanding of the sequence of operation of terminal 10 can be obtained by reference to FIG. 2 which is a flow diagram representation of the various steps involved in ordering the selected videocassette program material by use of terminal 10. Referring to FIG. 2, with the power on as represented by block 40, the terminal 10 is in the Standby Mode represented by block 42. In the Standby Mode, the system parameters are initialized. The word "Standby" is displayed at display station 22 and the videocassette player terminal 10 is rewound to the beginning of the videocassette tape. When initialization is completed, terminal 10 enters the Active Mode, as represented by block 44. In the Active Mode, the words "Insert Card" are flashed on display station 22 and the video-cassette player begins to play the videocassette tape which provides sequential preview of all available videocassette program material through monitor 16 and loadspeaker 18. If a customer does not use the terminal, NO ANSWER from block 46, the video cassette player will play through the entire videocassette, the system will return to the Standby Mode block 42, and terminal 10 is initialized again. This sequence of operation continues until a credit card is inserted into customer information station 20, at which time the answer from decision element 46 is YES. The credit card is held in the reader and data from the card is input to the computer and checked for correct format. If the credit card is improper, NO answers from decision element 48, the card is returned to the customer and a suitable message is displayed. If the credit card is proper, YES answer from decision element 48, terminal 10 enters the Customer Mode as indicated by block 50 and the message "Dial Program Number" is displayed at display station 22.

Next, as indicated by block 52, the catalog number, typically a three-digit number corresponding to the selected videocassette program material, is input into the terminal by pushing the appropriate push button at keying station 12. A "Clear" key is provided which will erase the number and allow selection to start all over again if a mistake is made. The "Clear" key may be used at any point in the transaction to return to the Dial Program Number state, Block 52, stopping any preview or order function currently in progress.

When the user finishes entering the number of the videocassette program material of his choice, a "Preview or Order" message appears at display station 22, as indicated by decision element 54. If the customer decides to preview the videocassette program material prior to ordering, he pushes the appropriate preview button at keying station 12, at which time the catalog number entered through keying station 12 is checked to insure that it is an active number, as indicated by decision element 56. If the number is not available, NO answer from decision element 56, a re-select message is displayed on display station 22, as indicated by block 58 and the terminal returns to the dial program number step indicated by block 52. If a valid number has been keyed into the system, YES answer from decision element 56, the number is converted by the computer to a tape address which is transmitted to the videocassette control system along with the length of the trailer and a search and play command, as indicated by block 60. In this mode, the message "Standby For Preview Number XXX" appears on display station 22, XXX representing the code number of the selected video cassette program material. When the videocassette player reaches the proper tape address, it begins playing, while the program title and catalog number are shown on display station 22. The video cassette player plays the entire preview of the selected videocassette program material and when the preview is complete the message "Press Order Or Clear For New Number" appears at display station 22, as indicated by decision element 62.

If the customer wishes to order the selected videocassette program material, Order answer from decision element 54, he presses the order pushbutton at keying station 12. First the number is checked and if an active number, Yes answer from decision element 63, the "VHS or BETA" message is displayed on display station 22 as represented by decision element 64. If the number is incorrect, No answer from decision element 63, the terminal is returned to the reselect block 58 and processing proceeds as above. The purpose of this decision element is to permit the user to select the appropriate videocassette format which will be compatible with the videocassette tape player which the customer will employ to play back the videocassette program material which is ordered. When the appropriate VHS or BETA button is pushed, an "OK" from decision element 64, the tape format, users card information and catalog number, and the date of the order are organized into a data record and stored in a temporary buffer, as indicated by block 66. Pressing any other key would result in a clear function which aborts the order and returns the terminal to the "Dial Program Number" mode, as indicated by block 52. Additional orders for additional video cassette program material can be made as indicated by decision element 68. Thus, if additional program material is desired, YES answer from decision element 68, the terminal 10 returns to the Dial Program Number mode, as indicated by block 52. The customer now selects a number and the same sequence of operation occurs permitting ordering of additional video cassette program material. If the customer does not desire additional videocassette program material, the "End of Order" button is pushed as indicated by a NO answer from decision element 68. It should be noted that the "End of Order" button can be pushed at any point in the transaction to abort the transaction. In the End of Order Mode, the computer checks to determine if any orders have been made. For orders that have been placed, the complete temporary data record is transferred from buffer memory to core memory for storage. The ordering information is sent to a printer and the customer is provided with a printed record of the transaction through receipt slot 26. A "Thank You" message is displayed on display station 22 and the credit card is returned to the customer through the customer information station 20. The unit then reenters the Standby Mode and the Active Mode and awaits the next customer to insert a credit card into terminal 10.

Referring now to FIG. 3, there is a block diagramatic representation of the internal elements of terminal 10. It will be understood that a worker skilled in the art will readily understand the operation of each of the individual components and how these components are functionally interconnected to provide an operative system. It is also understood that the various components and the system configuration are shown for illustrative purposes only and that various other components can be used as would be known to a worked skilled in this art. Therefore, the following will not provide an unnecessarily lengthy description of the operation of the system shown in FIG. 3.

Referring to FIG. 3, the terminal includes, tape player 80, such as a Sony Betamax SLP-300, and a 12 inch video monitor 82, which function together to provide the video display to preview the available videocassette program material; alpha-numeric character display 84, such as a Burroughs 32 character self scanning display which provides an alpha numeric readout at display station 22; card reader 86, such as AMP Model 210/211 magnetic card reader which accepts and reads ABA format credit cards to activate the unit; a 16 station key pad and assorted control keys 88 which allow the customer to communicate with terminal 10; and a printer 90 which issues a printed receipt for the orders at the end of the transaction. An MSC-8001 computer 92 having 8K core memory 96 supervises the operation of the entire terminal 10 through system control logic unit 94 which is interconnected with computer 92 and core memory 96 through Multibus 108. The system control logic 94 also controls a remote control unit 110, which, for example, is a Sony RM-300 which interfaces between system control logic unit 94 and video tape player 80. Multibus is the trademark used by Intel Corp. for an interconnecting back-plane assembly. Power is supplied via power supplies 100 and 102.

System control logic 94 required to control the operation of the system would be readily apparent to a worker skilled in this art based upon the foregoing descriptions. Further, the system control logic 94 will vary depending upon the particular components selected for the system. However, to provide some guidance for the design of system control logic 94, reference should be made to FIGS. 4, 5 and 6 which show portions of the system control logic for, respectively, the remote control unit 110 for the Betamax SLP videocassette player, the AMP, Inc. card reader 86 and the Burroughs keyboard 88. Since the construction and operation of the circuits shown in FIGS. 4, 5 and 6 will be readily apparent to a worker skilled in the art, only selected parts of the operation and construction of these circuits will be highlighted.

Figure 4:
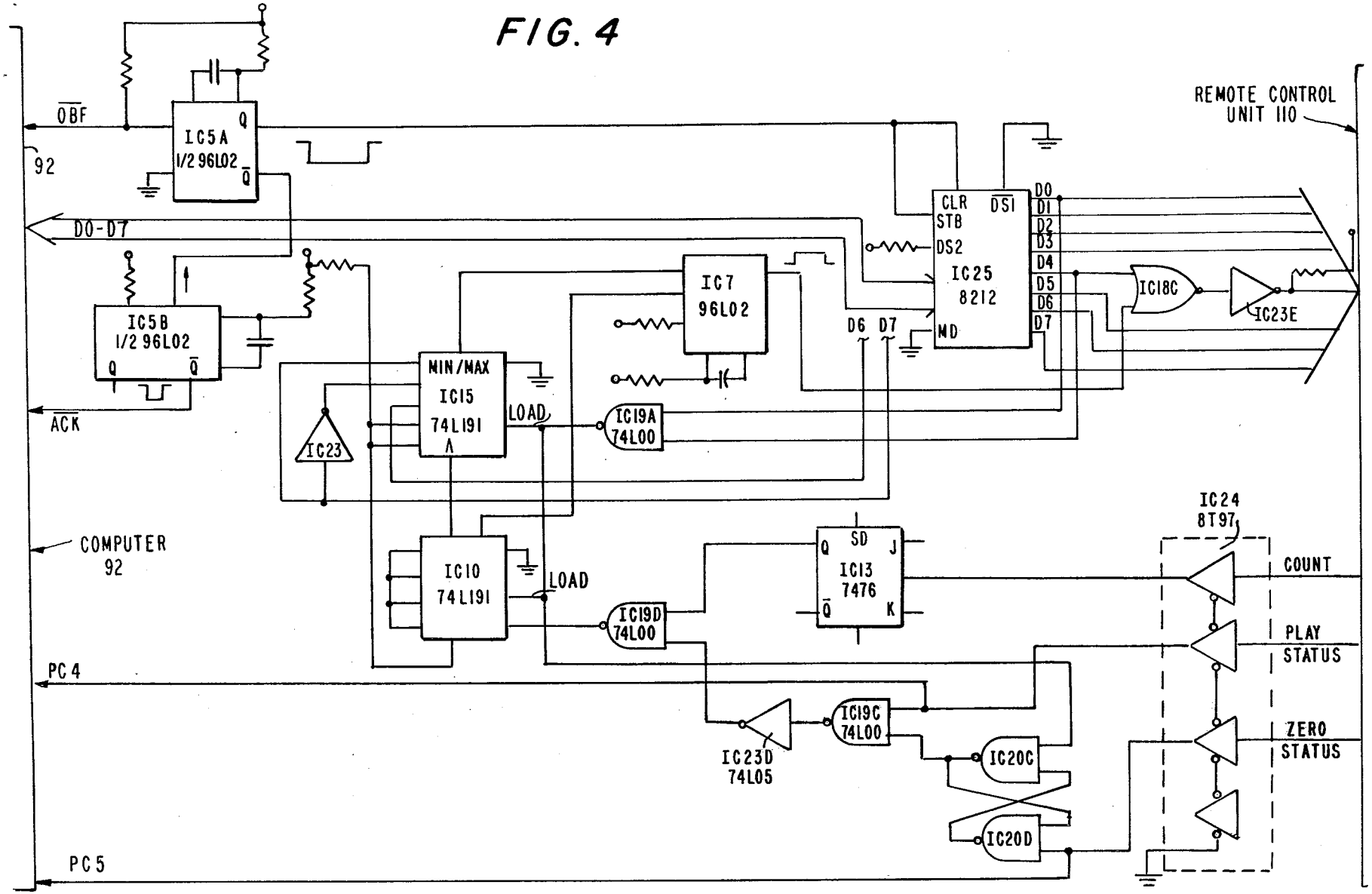
FIG. 4 is a circuit diagram of the control logic for controlling the operation of a typical videocassette playback unit used in conjunction with the display station to preview videocassette program material.

Referring to FIG. 4, which shows the logic for controlling a Betamax videocassette recorder via a modified Sony RM 300 remote control unit, a four-digit BCD tape address is sent to the remote control unit via output latch, IC 25, as well as the "Search and Play" command and the "Stop/Clear" command. IC 24 provides buffering for status information coming from the remote control unit 110 to allow the logic and computer to determine if the videocassette recorder is in play mode, to count control track pulses from the tape and to determine if the counter value is equal to zero. To keep computer 92 free for other functions, additional hardware is provided to supervise the entire preview operation. The only signals required from the computer to start a preview are a tape address, the "Search and Play" command, and a trailer length factor. This is accomplished through the following steps:

1. The 4-digit tape address is transmitted to the RM-300 via lines D0–D7.
2. The "Search and Play" command is issued via lines D0 and D4.
3. The trailer length factor is loaded into an 8 bit counter/latch comprised of IC-10 and IC-15.

When the videocassette recorder reaches the proper tape address, it starts playing. A play status line goes high, enabling control track pulses to reach the clock input of the counter/latch, IC-10 and IC-15, and the counter counts down until it reaches zero. At that time, the terminal count output of the counter/latch IC-10 and IC-15 goes active, and causes the "Stop/Clear" command to be issued. The videocassette recorder stops and the play status line drops, signaling the processor that the preview is complete.

For the videocassette recorder to play uninterruptedly during the active mode, the flip flop formed by two sections of IC-20 detects the zero status and disables the counter/latch until it is reenabled by a new "Search and Play" command. In a similar fashion, hand-shake signals between computer 92 and RM-300 are accomplished through IC-5.

Figure 5:
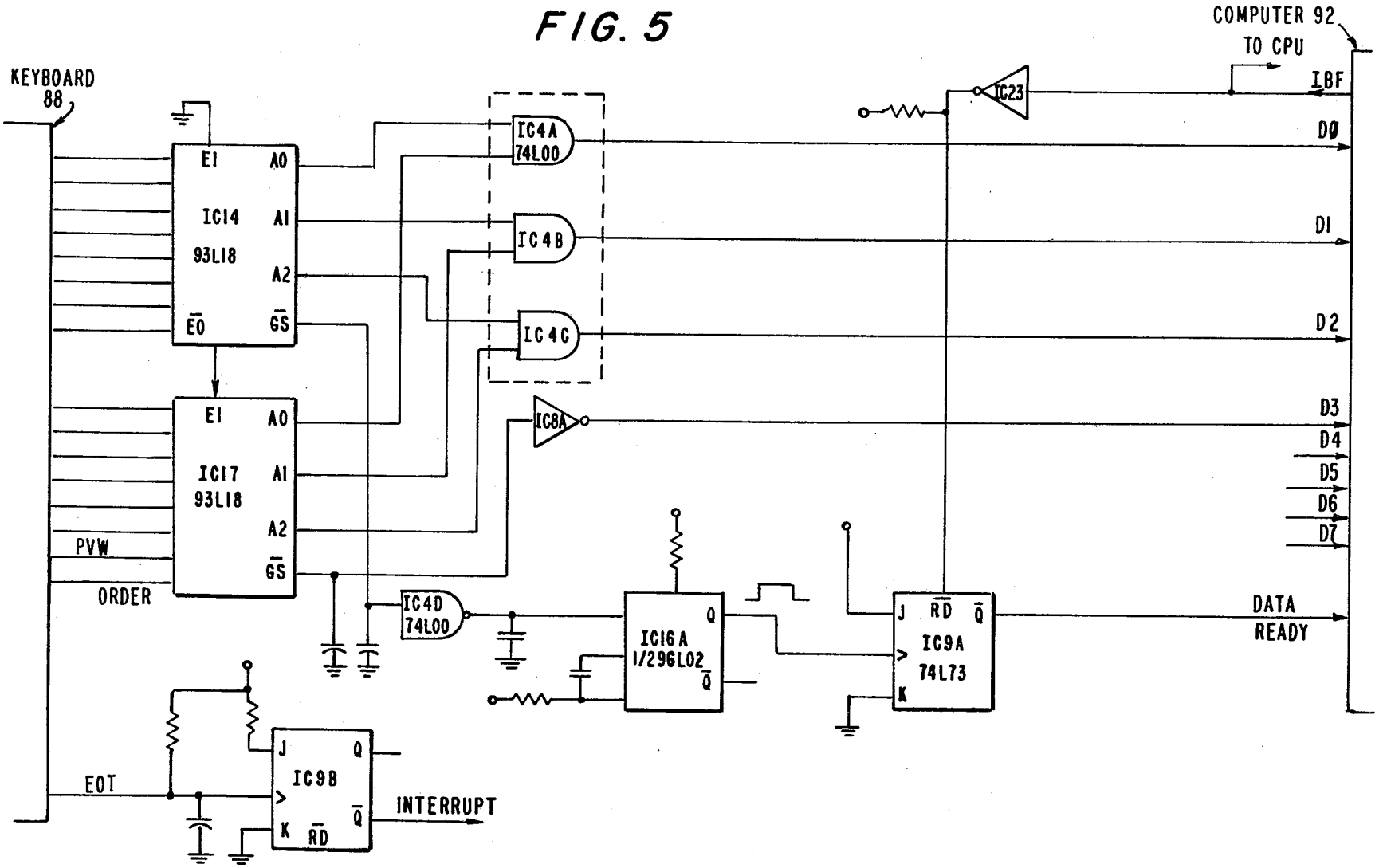
FIG. 5 is a circuit diagram of the control logic for controlling the operation of a typical keyboard used at the customer selection station.

Referring to FIG. 5, there is shown additional logic for controlling keyboard 88. The keyboard logic uses two 93L18 integrated circuits, IC-14 and IC-17 to accept a single pole key input and produce an encoded binary number at its output. Key Switch closings are "debounced" via IC-4D and IC-16A. IC-9A generates "handshake" logic to let computer 92 know that a key has been pressed and to accept acknowledgement from computer 92 that the encoded number has been received. The second section of IC-9, IC-9B, allows the "End of Order" button to directly generate a bus interrupt, insuring high priority for this function.

Figure 6:
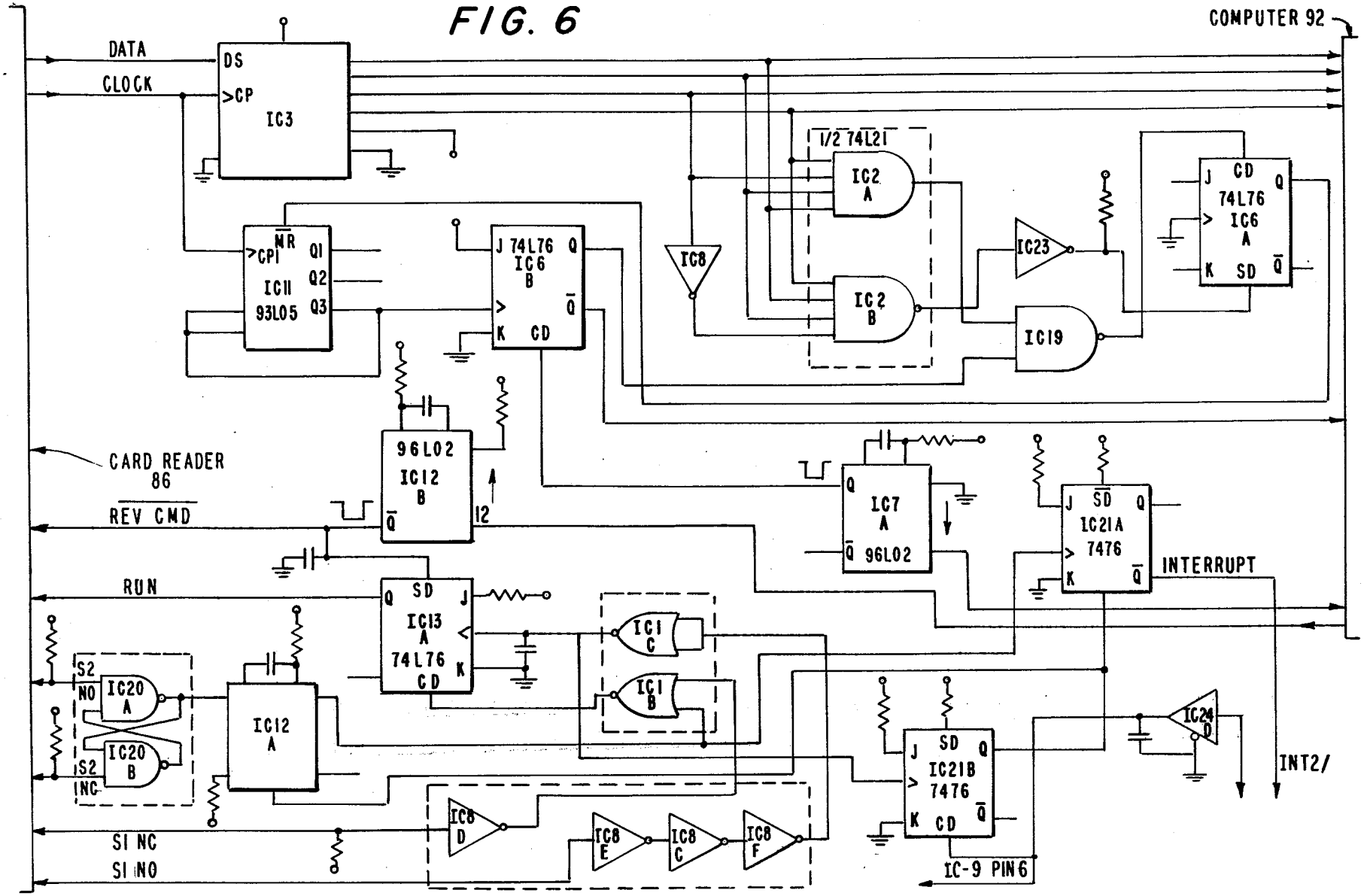
FIG. 6 is a circuit diagram of the control logic for controlling the operation of a card reader used at the customer identification station.

Referring to FIG. 6, there is shown the circuit for controlling the card reader 86. This interface consists of two sub-sections, a transport and control sub-section and a serial to parallel converter. The card reader transport control is activated by initially inserting an ABA format plastic card into the appropriate slot on the face of the terminal. This sets switch S1 in the reader and through logic formed by IC-8 subsections C through F and IC-1 subsections B and C and IC-13A engages the card and begins driving it over the read head. The setting of S1 also enables the data interrupt logic IC-21 subsections A and B, IC-24D normally kept disabled to prevent spurious interrupt. When the card is completely read, it sets switch S2 which clears the "Run" logic leaving the card inside the reader until the end of the transaction. When the card is to be returned, computer 92 issues a pulse to IC-12B causing both a "Run" and "Reverse Command" to be sent to the reader, driving the card back out to the user. When the card is completely clear, switch S1 disengages, stopping the motor.

The card reader electronics provides a serial TTL data stream and a TTL clock. These signals are used to load the shift register IC-3 as the card is read. The outputs of shift register IC-3 are fed continuously to the "Start Sentinal Detector", IC-2B, which upon detecting a 1101 data word, sets IC-6A, the "In-cycle" flip-flop. IC-6A enables IC-11 (Modulo 5 counter), and interrupts the CPU (via data interrupt logic) informing it that the valid card data will be available. As each data bit is clocked into the shift register, it is counted by IC-11. When 5 bits (4 data bits and one parity bit) have been counted, IC-11 sets IC-6B generating a strobe pulse that allows computer 92 to read the data word. IC-6B also enables the "Stop Sentinal Detector":, IC2A, which upon detecting a 1111 data word clears the "In-cycle" flip-flop and ends the data reading process.

In addition to the logic described in FIGS. 4, 5 and 6, modifications were also made to the Sony RM-300 remote control unit and the MSC-8001 computer. The Sony RM-300 unit was modified in two ways:

1. Changes were made to allow the RM-300 to accept commands directly from the computer instead of from its own keyboard.
2. Logic lines indicating counter-0, play status, and control track pulses were made available.

All of the above lines were brought out to an external connector for interfacing with the CPU.

The MSC-8001 Computer was modified as follows:

1. The multibus "NMI/" line (Non-Maskable Interrupt) was replaced with an "Intack/" line (interrupt acknowledged). This function formed by the logical OR of the processor "M1/" and CIORQ/ "signals" allows the CPU to inform an interrupting device that the interrupt has been received.
2. Use of the multibus "AACK/" line for transmission of the flash command for the display.
3. Reversal of the direction of parallel port 2C, bit 5 from computer 92. This line, although hard-wired as an output line, was unusable as such and was needed to provide status information to the processor from the RM-300.

All of the above modifications are well within the ordinary skill in this art and further details of these modifications are unnecessary.

Figure 7:
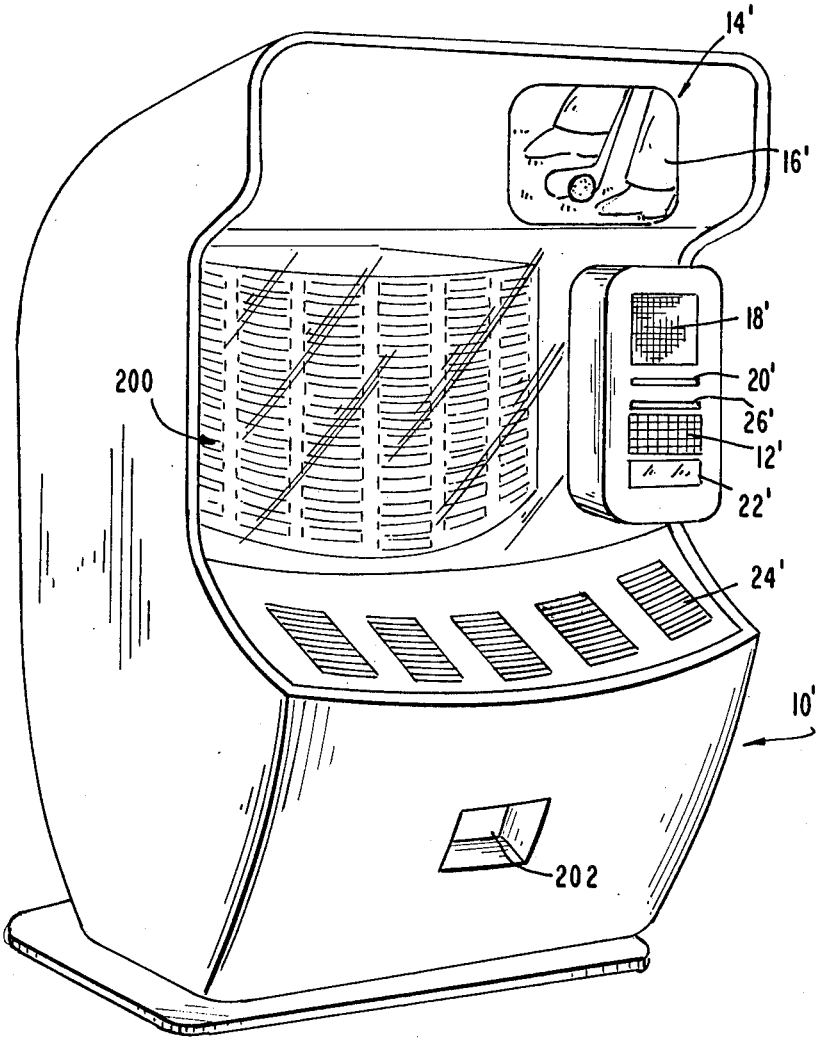
FIG. 7 is an isometric representation of an alternative embodiment of the invention in which videocassette program material is stored at the terminal and dispensed directly to a customer.

Alternatively, the terminal can be arranged to directly dispense selected videocassette program material. An illustrative embodiment showing a terminal for dispensing videocassette program material directly to the user is shown in FIG. 7. In FIG. 7, elements which are common to both the terminal shown in FIG. 1 and the terminal shown in FIG. 7 will be indicated by primed reference numerals. Referring to FIG. 7, terminal 10' includes a keying station 12', a display station 14', including a TV monitor 16' and speaker 18', a customer identification station 20', a display station 22', a code station 24', and a receipt station 26'. Arranged in terminal 10' is a mechanism for storing and dispensing videocassettes shown generally by reference numeral 200. This mechanism is of conventional design and is arranged to dispense a videocassette through dispensing station 202 when properly activated in response to ordering information input to the terminal. Selection and ordering of videocassette program material is accomplished through terminal 10' in the same manner as is accomplished through the use of terminal 10, and the order is received and processed in the manner already described. At the end of order, however, a signal is sent to the mechanism controlling the dispensing apparatus in terminal 10'. This signal activates the dispensing mechanism as is well-known in the art, and the selected videocassette program material is dispensed through outlet 202. With the alternate embodiment of the invention shown in FIG. 7, the customer does not have to wait for his order to be processed but can obtain the video-cassette program material immediately.

After the customer has completed using the videocassette, provision is made for return of the videocassette to the central location. In one mode, the videocassette is mailed by the customer to the central location. Alternatively, the terminal can include a return slot wherein the videocassette is deposited after use. Also, it should be understood that this invention can be used for dispensing of program material on video disc and that the description above should not be understood to limit the invention to dispensing of videocassette program material.

Additional changes and modifications to the embodiments of the invention as described herein can also be made, as will be apparent to those skilled in the art, while still remaining within the spirit and scope of the disclosed invention as set forth in the appended claims.

What I claim is:

1. A terminal at which a customer can preview desired videocassette program material and order such material, such order being processed at a processing location remote from said terminal, comprising means for selecting the desired videocassette program material, control means including a memory for storing data coupled to said selection means to receive and store data corresponding to the desired videocassette program material, means coupled to said control means for communicating data between selected memory locations in said control means and said processing location so that orders for selected videocassette program material can be processed at the processing location and the selected videocassette program material supplied to the customer, preview display means coupled to said control means for providing optional preview of said videocassette program material prior to selecting the desired videocassette material, said preview display means being adapted to successively display a plurality of previews of respective videocassette program materials for which orders can be placed by said customer from said terminal, and preview selection means coupled to said control means for altering the operation of said display means to permit selected videocassette program material to be displayed on said display means.

2. The terminal according to claim 1, wherein said preview display means includes a videotape playback device and a television monitor.

3. A terminal at which a customer can preview desired videocassette program material and order such material, such order being processed at a processing location remote from said terminal, comprising display means adapted to provide previews of a plurality of videocassette program materials, means for selecting videocassette program material, control means including a memory for storing data coupled to said selection means to receive and store data corresponding to selected videocassette program material, decision means coupled to said selection means, said display means and said control means and adapted to cause said display means to display the videocassette program material selected with said selection means or to generate ordering data associated with the videocassette program material selected with said selection means, and means coupled to said control means for communicating said ordering data between selected memory locations in said control means and said processing locations.

4. The terminal according to claim 3, further comprising a card reader coupled to said control means for obtaining information relative to the customer using said terminal.

5. The terminal according to claim 3, wherein said display means is adapted to successively display a plurality of previews of respective videocassette programs for which orders can be placed by a customer from said terminal.

6. The terminal according to claim 3, wherein said preview display means includes a videotape playback device and a television monitor.

7. A method of previewing and ordering videocassette program materials at a terminal, said order being processed at a processing location remote from the terminal, comprising the steps of entering data corresponding to particular videocassette program material into a memory provided at said terminal, displaying a preview of the videocassette program material corresponding to said data at said terminal and transmitting said data stored in said memory to said processing location for processing thereat.

* * * * *